US006758575B2

(12) United States Patent
Winkler

(10) Patent No.: US 6,758,575 B2
(45) Date of Patent: Jul. 6, 2004

(54) DECORATIVE APPARATUS AND METHOD OF MANUFACTURE

(76) Inventor: Stephen C. Winkler, 3969 Noblin Creek Dr., Duluth, GA (US) 30097

( * ) Notice: Subject to any disclaimer, the term of this patent is extended or adjusted under 35 U.S.C. 154(b) by 0 days.

(21) Appl. No.: 10/136,681

(22) Filed: Apr. 30, 2002

(65) Prior Publication Data

US 2003/0202343 A1 Oct. 30, 2003

(51) Int. Cl.[7] ..... F21L 19/00

(52) U.S. Cl. ..... 362/171; 362/161; 362/158; 362/96; 362/154; 431/320

(58) Field of Search ..... 362/164, 171, 362/173, 174, 182, 161, 162, 158, 157, 96, 154; 431/320, 321, 322, 324, 34, 125, 126

(56) References Cited

U.S. PATENT DOCUMENTS

| | | | | |
|---|---|---|---|---|
| 3,063,278 A | | 11/1962 | Van Tubergen | |
| 3,614,417 A | | 10/1971 | Sanford | 240/52 R |
| 4,511,952 A | | 4/1985 | Vanbragt | 362/181 |
| 4,728,286 A | | 3/1988 | Olsen | 431/320 |
| 4,875,852 A | | 10/1989 | Ferren | 431/324 |
| 5,012,393 A | | 4/1991 | Knipe et al. | 362/163 |
| 5,086,380 A | * | 2/1992 | Hedner, Jr. | 362/161 |
| 5,654,022 A | * | 8/1997 | Sayre | 426/118 |
| 6,290,914 B1 | * | 9/2001 | LeJeune et al. | 422/125 |
| 6,511,314 B2 | * | 1/2003 | Johnson | 431/321 |

FOREIGN PATENT DOCUMENTS

GB 2299159 A * 9/1996 ..... F23D/3/02

OTHER PUBLICATIONS www.aftosa.com, AFTOSA Pottery & Craft Supplies, "Glass Wick Holder," 1 page, printed Apr. 2, 2002.

www.nationalartcraft.com, National Artcraft Co., "Glass Lamp Oil Insert," 3 pages, printed Apr. 2, 2002.

www.AFTOSA BISQUE, "Candle Lamp Kit," 1 page, printed Apr. 25, 2002.

www.aftosa.com, AFTOSA BISQUE, "Electric & Candle Lamps," 2 pages, printed Jun. 19, 2002.

* cited by examiner

*Primary Examiner*—Sandra O'Shea
*Assistant Examiner*—Guiyoung Lee
(74) *Attorney, Agent, or Firm*—Thomas, Kayden, Horstemeyer & Risley, LLP

(57) ABSTRACT

A decorative apparatus comprises a primary container defined by an upper portion and a lower portion. The primary container has an opening defined in the upper portion. A secondary container comprises a cap and a reservoir body extending therefrom. The secondary container is suspendedly disposed within the primary container such that the cap of the secondary container substantially corresponds to the opening of the primary container and the reservoir body of the secondary container extends toward the lower portion of the primary container. A reservoir access aperture is disposed in the cap. A method of manufacture is also provided.

45 Claims, 5 Drawing Sheets

DECORATIVE APPARATUS AND METHOD OF MANUFACTURE

TECHNICAL FIELD

The present invention is generally related to a decorations and more particularly, is related to a decorative apparatus and method of manufacture.

BACKGROUND OF THE INVENTION

Jars and containers of various configurations and colors are popular for decorating various settings and rooms in both commercial and residential venues. Theses decorative jars and containers are typically displayed either empty or containing a variety of items. Empty containers are typically displayed for their unique color, shape, or the like. Empty containers can also easily be used to support a candle in the opening of the jar or container to add an extra decorative element. Where the container is empty there is no need to keep the container closed and sealed.

Decorative jars and containers displayed with contents inside can contain a variety of items. One popular item to display inside a jar or container is food products, such as pasta, fruits, vegetables, herbs, combinations thereof, or the like. Where non-perishable, or essentially non-perishable, goods are used, such as, for example, pasta or dried herbs, it is not critical that the container remain closed and sealed shut. Therefore, a candle can be positioned in an opening of the container, as desired, without jeopardizing the contents therein.

Where perishable goods are disposed within the decorative container, including but not limited to fruits, vegetables, or the like, care must be taken to preserve the food products therein. As such, food products in these containers are often packed in a preservative, such as vinegar, or the like. It is also important that the container remain closed and sealed. An opening of the jar or container is typically sealed with a cork or some similar stopper. Such containers are often finished with a wax or plastic coating disposed over the cork and a portion of the decorative jar for aesthetic and functional purposes. Depending on the look desired, the container can be displayed with the seal removed from a portion or all of the cork or stopper and jar or the seal can be left intact.

Unlike with empty jars and containers containing non-perishable goods, it is difficult to incorporate a source of flame, such as a candle, or the like, with decorative jars and containers containing perishable items. A mere candle alone disposed in the opening in lieu of the cork or stopper can introduce air to the perishable products disposed within the jar and accelerate the decomposition process. It is also undesirable to pack the perishable products in oil or another flammable fluid into which a wick can be introduced, because oil does not sufficiently preserve the perishable goods. Additionally, the amount of fluid inside the jar decreases as the fluid is burned, thereby accelerating the decomposition process and creating undesirable visual appearances.

Thus, a heretofore unaddressed need exists in the industry to address the aforementioned deficiencies and inadequacies.

SUMMARY OF THE INVENTION

Preferred embodiments of the present invention provide a decorative apparatus and method of manufacture. Briefly described, in architecture, one embodiment of the apparatus can be implemented as follows. A decorative apparatus comprises a primary container defined by an upper portion and a lower portion. The primary container has an opening defined in the upper portion. A secondary container comprises a cap and a reservoir body extending therefrom. The secondary container is suspendedly disposed within the primary container such that the secondary container is sealingly engaged to the opening of the primary container, and the reservoir body of the secondary container extends toward the lower portion of the primary container. A reservoir access aperture is disposed in the cap.

Preferred embodiments of the present invention can also be viewed as providing methods of manufacturing a decorative apparatus. In this regard, one embodiment of such a method, among others, can be broadly summarized by the following steps: providing a primary container having an upper portion with an opening and a lower portion; providing a secondary container having a cap and a reservoir body extending therefrom; and providing a reservoir access aperture disposed in the cap of the secondary container. The secondary container is configured to fit inside the primary container in a sealed and suspended manner.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

Figure 1:
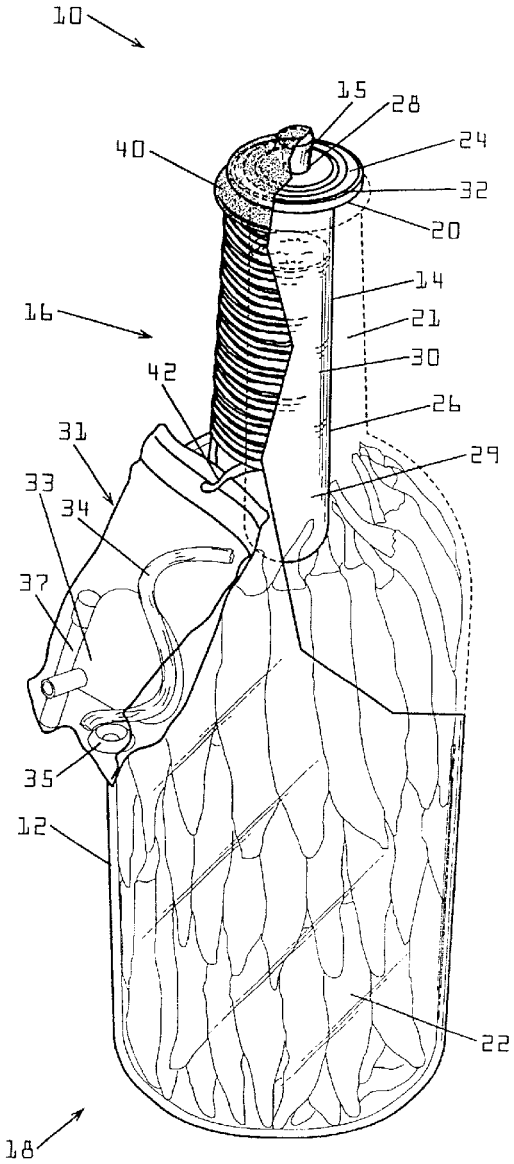
FIG. 1 is a cutaway side perspective view of an unassembled preferred embodiment of a decorative apparatus of the present invention.
Figure 2:
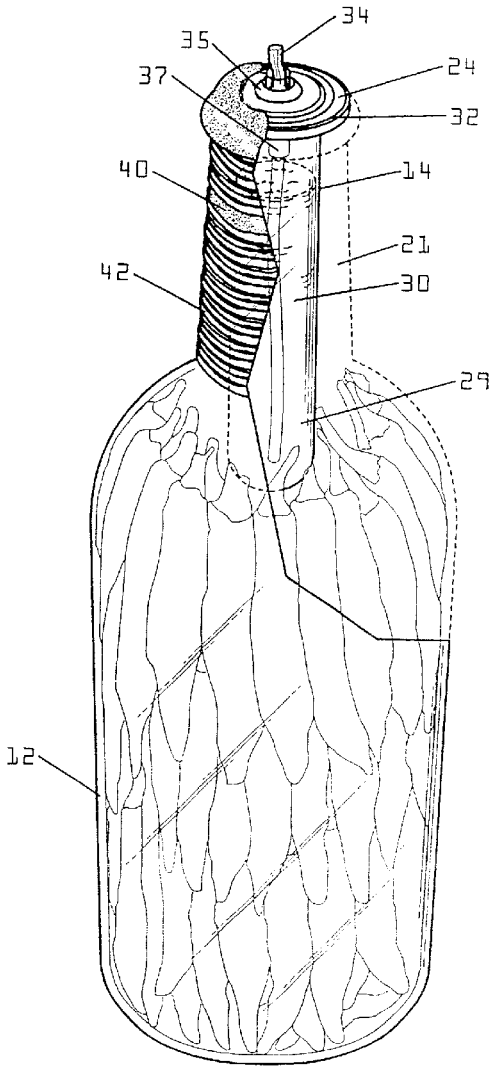
FIG. 2 is a cutaway side perspective view of the decorative apparatus illustrated in FIG. 1 as assembled.
Figure 2A:
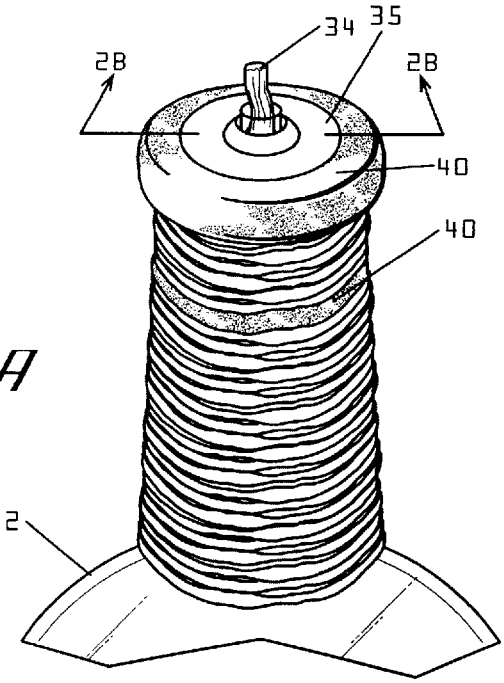
FIG. 2A is a partial perspective view of the decorative apparatus illustrated in FIG. 2.
Figure 2B:
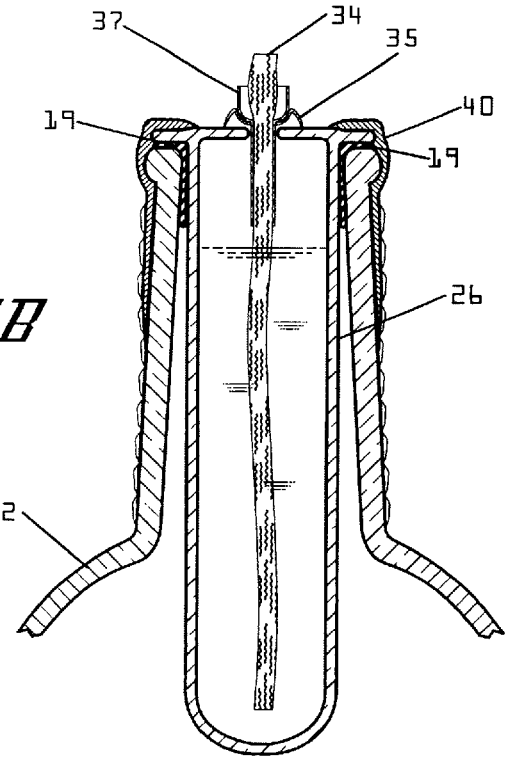
FIG. 2B is a side cross-section view of the decorative apparatus illustrated in FIG. 2A.

FIG. 1 illustrates one preferred embodiment of an unassembled decorative apparatus 10 of the present invention, and FIGS. 2–2B show the apparatus 10 in an assembled arrangement. The decorative apparatus 10 comprises a primary container 12 and a secondary container 14. The primary container 12 is defined by an upper portion 16 and a lower portion 18. An opening 20 is defined in the upper portion 16 of the primary container 12. The opening 20 provides access to an interior cavity 21 of the primary container 12. The primary container 12 is configured to receive and contain various contents, such as a food product 22, disposed therein. A preservative can also be disposed in the primary container 12. Such products 22 can be disposed in the primary container 12 through the opening 20. The primary container 12 can comprise any suitable shape or form and any suitable material, such as glass, plastic, or the like. Furthermore, although the primary container 12 is illustrated herein as comprising a freestanding bottle container having an essentially flat bottom disposed toward the lower portion 18 thereof, it should be understood that the primary container 12 can be freestanding or require a stand, support, or the like, to remain in a substantially stable position. It is preferable that the secondary container 14 is arranged and configured to be disposed within the primary container 12 in a suspended manner toward the upper portion 16 at the opening 20, as shown.

The secondary container 14 comprises a cap 24 having a reservoir body 26 extending therefrom. A reservoir access aperture 28 is defined in the cap 24, and a cork 15 is shown sealingly engaging the aperture 28. The reservoir access aperture 28 provides access to an interior cavity 29 of the reservoir 26. Various substances can be introduced into the reservoir 26 through the reservoir access aperture 28, such as flammable fluid 30.

The cap 24 can optionally comprise a lip 32 extending beyond a diameter defining the reservoir 26. The optional lip 32 can be arranged and configured to engage a perimeter of the opening 20 of the primary container 12. In this configuration, the secondary container 14 can be suspended within the primary container 12 by engagement of the lip 32 with the perimeter around the opening 20 such that the reservoir 26 extends into the primary container 12 toward the lower portion 18 thereof. The engagement can be secured with an adhesive 19, as shown in FIG. 2B, which also continues down the reservoir body 26 to form a seal to prevent leakage from the interior cavity 21.

Figure 3:
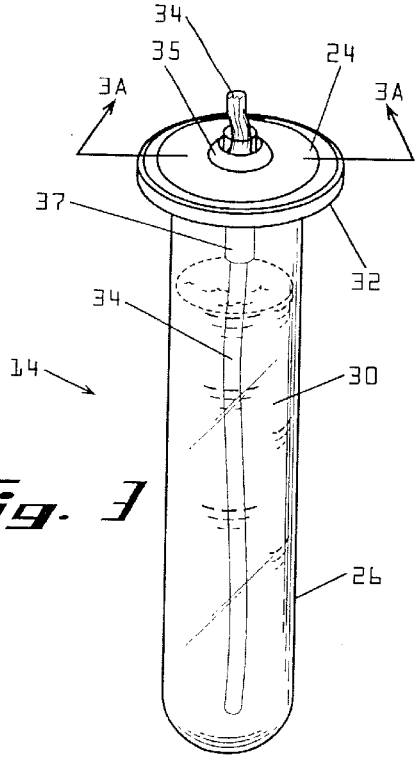
FIG. 3 is a side perspective view of the secondary container of the decorative apparatus illustrated in FIG. 2.
Figure 3A:
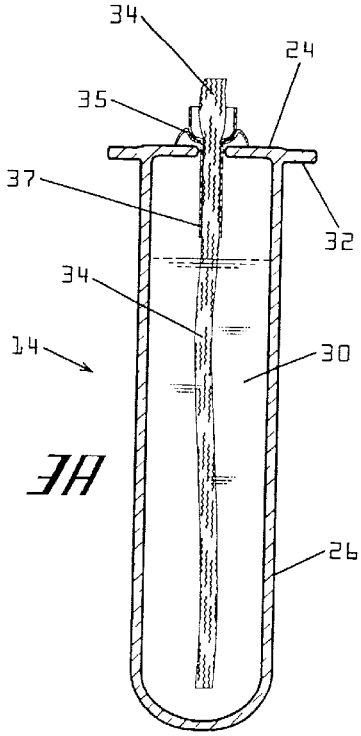
FIG. 3A is a side cross-section view of the secondary container illustrated in FIG. 3.
Figure 4:
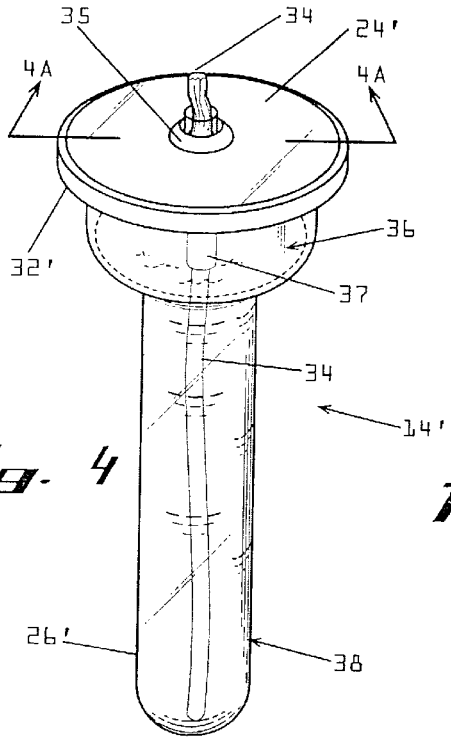
FIG. 4 is a side perspective view of another preferred embodiment of a secondary container.
Figure 4A:
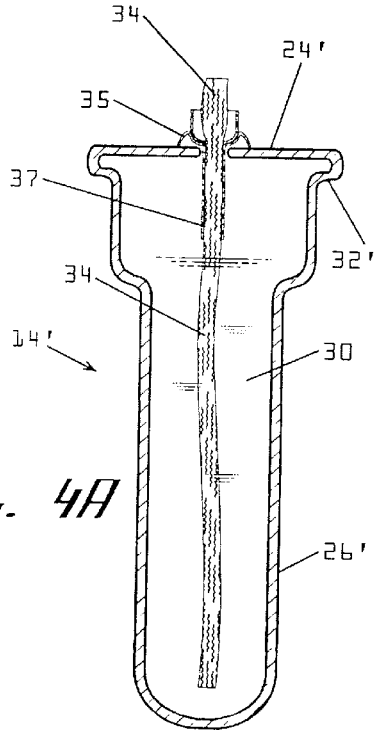
FIG. 4A is a side cross-section view of the secondary container illustrated in FIG. 4.
Figure 5:
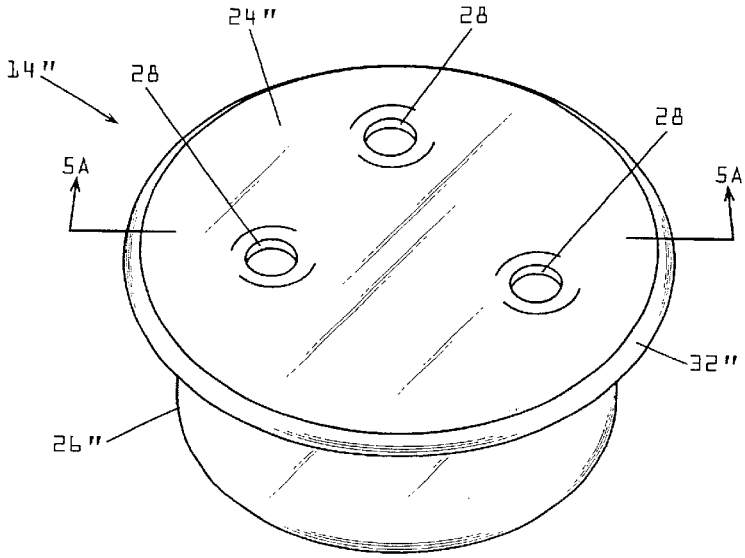
FIG. 5 is a side perspective view of another preferred embodiment of a secondary container.
Figure 6:
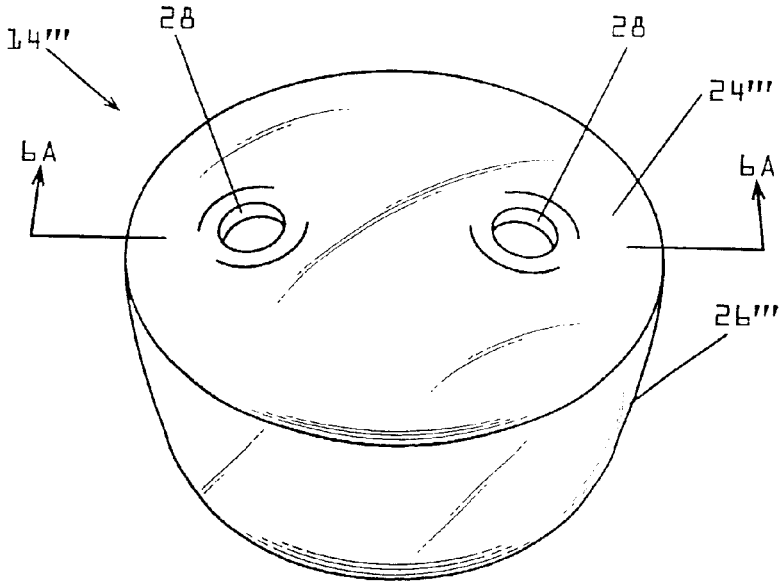
FIG. 6 is a side perspective view of another preferred embodiment of a secondary container.
Figure 6A:
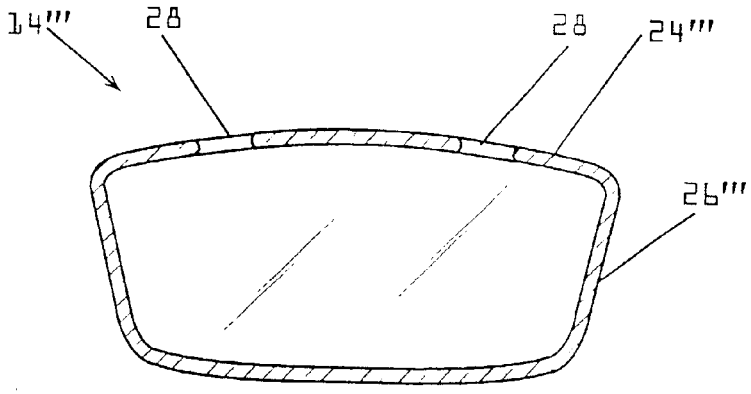
FIG. 6A is a side cross-section view of the secondary container illustrated in FIG. 6.

The reservoir 26 can comprise any shape suitable for receiving and containing fluid therein. As illustrated in FIGS. 3–4A, the reservoir 26 can comprise, among others, a substantially elongated "test-tube shape" or, as illustrated in FIGS. 5–6A, a substantially "cup shape." The elongated reservoir 26 can comprise a substantially constant diameter throughout (FIGS. 3 and 5) or variable diameters in the form of multiple sections of substantially constant diameters (FIG. 4), or a substantially tapering diameter (FIG. 6), among others. It is also useful, though not required in embodiments with a lip 32, to construct the region below the cap 24 to be only slightly smaller than the opening 20. Regardless of the shape, the reservoir 26 is preferably arranged and configured to receive and contain a fluid, such as flammable fluid 30, and a wick 34, therein.

The wick 34 can comprise any suitable natural or synthetic material and can be introduced into the reservoir 26 through the reservoir access aperture 28. Preferably constructed of glass, plastic, or any suitable material, a wick support 37 is also shown with an upper portion of larger diameter than a lower portion to support the wick 34 as shown. The grommet 35 supports the upper enlarged portion of the wick support 37 as shown, but the grommet 35 can also be flipped to contain scented oil, or the like. Where more than one reservoir access aperture 28 is provided (FIGS. 5 and 6), a wick 34 and support 37 can be introduced into the reservoir 26 through each reservoir access aperture 28 It is preferable that the wick 34 is disposed in the secondary container 14 such that a portion of the wick 34 extends therefrom while the remainder of the wick 34 extends into the reservoir 26.

Referring more specifically to FIGS. 4 and 4A, the reservoir 26' comprises a larger diameter enlarged portion 36 toward the cap 24' and a smaller diameter decreased portion 38 opposing the cap 24'. Upon disposal into a primary container (not shown) of this configuration of the secondary container 14', the enlarged portion 36 of the reservoir 26' can engage an interior of the primary container toward the upper portion 16 of the primary container in which the secondary container 14' is disposed. The decreased portion 38 displaces a smaller amount of food product 22 contained within the primary container.

The reservoir 26' is topped with a cap 24'. The cap 24' can include the optional lip 32', as well as one or a plurality of reservoir access apertures 28 disposed therein. The optional lip 32' can engage a perimeter around the opening 20 of the primary container 12. Flammable fluid 30 can be introduced into the reservoir 26' through the reservoir access aperture 28, as can a wick 34. The wick 34 is preferably positioned such that a portion of the wick 34 extends outside of the secondary container 14' through the reservoir access aperture 28 while a portion of the wick 34 is disposed within the reservoir 26' and the flammable fluid 30 contained therein.

The grommet 35 can be disposed under the enlarged upper portion of the wick support 37 at the reservoir access aperture 28. Where a plurality of reservoir access apertures 28 are disposed in the cap 24', and a plurality of wicks 34 are disposed, one in each of the reservoir access apertures 28, a plurality of grommets 35 and wick supports 37 can be included, one of each of the plurality being disposed substantially adjacent each of the plurality of reservoir access apertures 28. The grommet 35 can optionally be flipped over in a substantially concave shape, as discussed above, to receive and contain a fluid, such as a scented oil, or the like, therein.

Figure 5A:
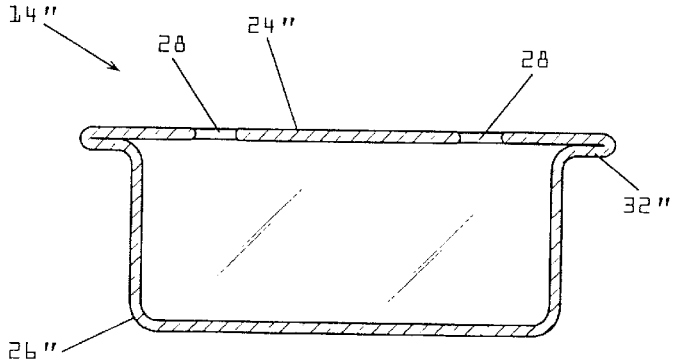
FIG. 5A is a side cross-section view of the secondary container illustrated in FIG. 5.

Referring next to FIGS. 5 and 5A, the secondary container 14" comprises a "cup-shape" reservoir 26". The reservoir 26" is topped with a cap 24" comprising a lip 32" extending beyond a diameter defining the reservoir 26". A plurality of reservoir access apertures 28 are disposed therein. FIG. 5 illustrates three reservoir access apertures 28 disposed therein, however, it should be understood that any desired number of reservoir access apertures 28 may be included. As illustrated in FIG. 5, the lip 32" can engage a perimeter around the opening 20 from which the reservoir 26" can be suspended within the primary container 12. This embodiment of the secondary container 12 can further comprise flammable fluid 30, a wick 34, a wick support 37, and a grommet 35 as disclosed above.

Referring next to FIGS. 6 and 6A, another embodiment of the secondary container 14'" is illustrated. In this embodiment, the secondary container 14'" comprises a substantially "cup-shape" and tapered reservoir 26'". The reservoir 26'" is topped with a cap 24'" having no lip 32'", or the like, extending beyond the diameter of the reservoir 26'''. As illustrated, the cap 24''' comprises a pair of reservoir access apertures 28 disposed therein, however, it should be understood that any desired number of reservoir access apertures 28 can be included. In this configuration, the secondary container 14''' can be disposed within a primary container 12 at the opening 20 such that the sides of the reservoir 26''' engage an interior of the primary container 12 toward the upper portion 16 thereof in a wedging manner, thereby suspending the secondary container 14''' within the primary container 12. As discussed above, the reservoir 26''' can receive and contain flammable fluid 30 therein. A wick 34 can be disposed in each of the pair of reservoir access apertures 28 such that a portion of the wick 34 extends out of the reservoir access aperture 28 while the remainder of the wick 34 extends into the reservoir 26'''. A grommet 35 can be disposed under the enlarged upper portion of the wick support 37 at the reservoir access aperture 28.

In each of the disclosed preferred embodiments, the flammable fluid 30 absorbed into the wick 34 can be ignited. Upon burning all of the flammable fluid 30 out of the reservoir 26, the wick 34 can be removed, additional flammable fluid 30 can be introduced using funnel 33 into the reservoir 26 through the reservoir access aperture 28, and the wick 34, grommet 35 and wick support 37, re-positioned.

Regardless of the shape or configuration of the secondary container 14, the secondary container 14 can be disposed within the primary container 12, preferably at the opening 20, until the reservoir 26 is wedged therein, until the lip 32 engages a perimeter around the opening 20, or a combination thereof. A coating seal 40 can be disposed on the decorative apparatus 10, preferably toward the upper portion 16 of the primary container 12 and on the cap 32 of the secondary container 14 (FIG. 1). In another embodiment, the seal 40 is disposed only on the primary container 12 toward the upper portion 16 (FIG. 2). In yet another embodiment, the seal 40 is disposed on the primary container 12 toward the upper portion 16 and on a portion of the cap 32 of the secondary container 14, revealing the reservoir access aperture 28 (FIG. 2A). Furthermore, portions of the seal 40 may be cut away in varying amounts upon assembly. The decorative apparatus 10 can optionally comprise a decorative accent 42, such as rope, string, or raffia wrapped around the primary container 12 toward the upper portion 16 thereof.

It should be noted that the disclosed configurations of the secondary container 14 are merely various embodiments of the secondary container 14 and that the secondary container 14 is not limited to those embodiments. Rather, the secondary container 14 can comprise any suitable configuration. Furthermore, each of the illustrated configurations of reservoirs 26 can be paired with a cap 24 either having the optional lip 32 or without the optional lip 32. It should also be noted that any of the configurations of the secondary container 14 can comprise any suitable number of reservoir access apertures 28 disposed therein. The secondary container 14 can comprise any suitable material, such as glass or plastic, and can be formed in any suitable method for working with such materials.

The preferred embodiment of the present invention also includes methods for manufacturing and assembling a decorative apparatus 10. Referring first to FIG. 1, the primary container 12 and the secondary container 14 are provided as described above, and can be molded, glass blown, or the like, depending upon the materials from which they are formed. Desired contents, such as a food product 22, can be disposed within the primary container 12. The food product 22 is preferably disposed within the primary container 12 through the opening 20. A preservative, such as vinegar, or the like, can also be disposed within the primary container 12.

The secondary container 14 is disposed within the primary container 12 at the opening 20 thereof. The secondary container 14 is inserted into the opening 20 of the primary container 12, such that the reservoir 26 extends toward the lower portion 18 of the primary container, until a portion of the reservoir 26 engages an interior portion of the secondary container 14, a portion of the cap 24, such as the optional lip 32, engages a perimeter around the opening 20, or a combination thereof.

An optional adhesive can be used to affix the secondary container 14 within the primary container 12. As discussed above, the secondary container 14 can contact the primary container 12 at various contact points. It is preferable that the optional adhesive is disposed on at least one of the contact points to help secure the secondary container 14 in position in the primary container 12.

In one method of manufacture, upon disposal of the food product 22, optional preservative, and secondary container 14 into the interior cavity 21 of the primary container 12, a flammable fluid 30 can then be introduced into the reservoir 26 of the secondary container 14 through the reservoir access aperture 28, which is then plugged with a cork 15. Other embodiments include introducing the flammable fluid 30 and cork 15 before the secondary container 14 is inserted into the primary container 12. A seal 40 can be disposed around the upper portion 16 of the primary container 12 and over the cap 24 of the secondary container 14 by dipping same in wax, thus forming an additional seal for the interior cavity 21. A wick 34 can be included with a grommet 35, a funnel 33, and a wick support 37 in a plastic bag 31 that is attached to the primary container 12 as shown in FIG. 1.

During one method of assembly, after a customer purchases the unassembled decorative apparatus 10 of FIG. 1, the coating seal 40 can be removed from at least the reservoir access aperture 28, exposing the cork 15, which is removed. The funnel 33, wick 34, grommet 35, and wick support 37 are removed from the accessory bag 31, or the like, and assembled as shown in FIG. 2B. The exposed portion of the wick 34 can then be ignited. In methods of manufacture, assembly and use, it should be noted that removal of the seal 40 can comprise removal of the seal in various manners. More specifically, the seal 40 can be removed from around the entire cap 24 and lip 32 of the secondary container 14. In this configuration, the cap 24 as well as the optional lip 32 are exposed during use. In another configuration, the seal 40 is removed only from a portion of the cap 24, as shown in FIG. 2. In this configuration, a portion of the cap 24 and the optional lip 32 remains covered by the seal 40, as well as the upper portion 16 of the primary container 12. It should also be understood that the seal 40 can be removed completely from the secondary container 14 and the primary container 12. The seal 40 can comprise wax, plastic, or the like.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A decorative apparatus, comprising:

a primary container defined by an upper portion and a lower portion, said primary container having an opening defined by a perimeter disposed toward said upper portion;

a secondary container having a cap and a reservoir body extending therefrom, said secondary container being scalingly engaged to and suspendedly disposed within said primary container, and said reservoir body of said secondary container extending toward said lower portion of said primary container, said secondary container defining a reservoir access aperture disposed in said cap;

contents disposed within said primary container; and adhesive disposed between said primary container and said secondary container sealingly engaging said secondary container to said primary container and sealing said contents between said primary container and said secondary container;

wherein said adhesive being adapted to seal said contents between said primary container and said secondary container in order to inhibit introduction of air to said contents, uninhibited introduction of which may result in decay or evaporation of said contents.

2. The decorative apparatus of claim 1, wherein said cap of said secondary container further comprises:

a lip extending beyond a perimeter of said reservoir body;

wherein at least a portion of said lip is ranged and configured to engage at least a portion of said perimeter of said opening of said primary container.

3. The decorative apparatus of claim 2, wherein an upper portion of said reservoir body engages an interior portion of said upper portion of said primary container.

4. The decorative apparatus of claim 1, wherein an upper portion of said reservoir body engages a portion of an interior of said upper portion of said primary container thereby suspending said secondary container within said primary container.

5. The decorative apparatus of claim 1, further comprising:

a wick disposed in said secondary container extending within said reservoir, wherein a portion of said wick passes through said reservoir access aperture and extends out of said secondary container; and a flammable fluid disposed in said reservoir.

6. The decorative apparatus of claim 5, further comprising;

a grommet disposed on said cap substantially corresponding to said reservoir access aperture;

wherein said grommet is arranged and configured to surround said wick at said reservoir access aperture.

7. The decorative apparatus of claim 5, wherein said grommet is substantially concave such that liquid can be contained therein.

8. The decorative apparatus of claim 7, wherein said liquid disposed in said grommet comprises a scented oil.

9. The decorative apparatus of claim 1, wherein said cap of said secondary container comprises a plurality of reservoir access apertures disposed through said cap.

10. The decorative apparatus of claim 9, further comprising:

a plurality of wicks; and a plurality of grommets;

wherein each of said plurality of reservoir access apertures receives one of said plurality of wicks therein and each of said plurality of wicks receives one of said plurality of grommets therearound such that each of said plurality of grommets contacts a portion of said cap substantially adjacent said reservoir access aperture.

11. The decorative apparatus of claim 1, wherein said secondary container comprises glass.

12. The decorative apparatus of claim 1, wherein said secondary container comprises plastic.

13. The decorative apparatus of claim 1, wherein:

contents disposed within said primary container comprises a food article.

14. The decorative apparatus of claim 13, wherein said contents comprise a food article.

15. The decorative apparatus of claim 1, further comprising:

a preservative disposed within said primary container.

16. The decorative apparatus of claim 1, wherein said primary container comprises glass.

17. The decorative apparatus of claim 1, wherein said primary container comprises plastic.

18. The decorative apparatus of claim 1, further comprising:

a seal disposed around an outer portion of said primary container toward said upper portion of said primary container and around said cap of said secondary container.

19. The decorative apparatus of claim 1, further comprising:

a seal disposed around an outer portion of said primary container toward said upper portion of said primary container.

20. The decorative apparatus of claim 1, further comprising:

a seal disposed around an outer portion of said primary container toward said upper portion of said primary container and on a portion of said secondary container.

21. The decorative apparatus of claim 20, wherein said seal comprises wax.

22. The decorative apparatus of claim 1, further comprising:

flammable fluid;

a funnel arranged and configured to facilitate disposal of said flammable fluid into said reservoir of said secondary container through said reservoir access aperture; and a wick arranged and configured to be received through said reservoir access aperture into said reservoir;

wherein said flammable fluid, said funnel and said wick accompany said decorative apparatus.

23. The decorative apparatus of claim 1, wherein said cap and said reservoir of said secondary container cover said opening of said primary container thereby enclosing an interior cavity of said primary container.

24. A method of manufacturing a decorative apparatus comprising:

providing a primary container having an upper portion, a lower portion and an opening disposed toward said upper portion;

providing a secondary container having a cap and a reservoir body extending therefrom;

disposing contents within said primary container;

disposing at least a portion of said secondary container within said primary container, said contents being disposed between said primary container and said secondary container;

providing an adhesive disposed between said primary container and said secondary container seallingly engaging said secondary container to said primary container, said adhesive being adapted to seal said contents between said primary container and said secondary container in order to inhibit introduction of air to said contents, uninhibited introduction of which may result in decay or evaporation of said contents; and providing a reservoir access aperture disposed in said cap of said secondary container;

wherein said secondary container is configured to be sealingly engaged to and suspendedly disposed within said primary container, and said reservoir body of said secondary container extending toward said lower portion of said primary container.

25. The method of claim 24, further comprising:

disposing said secondary container within said primary container;

wherein a portion of said secondary container engages a portion of said primary container.

26. The method of claim 25, wherein a portion of said cap of said secondary container engages a portion of said opening of said primary container.

27. The method of claim 25, wherein a portion of said reservoir of said secondary container engages a portion of said primary container.

28. The method of claim 25, further comprising:

providing a wick arranged and configured to be received in said reservoir access aperture and extend into said reservoir;

providing flammable fluid;

providing a funnel for disposing said flammable fluid into said reservoir through said reservoir access aperture.

29. The method of claim 25, wherein said step of disposing contents within said primary container comprises disposing of a food product in said primary container.

30. The method of claim 29, wherein said step of providing contents in said primary container comprises providing a food article.

31. The method of claim 24, further comprising:

disposing flammable fluid in said reservoir of said secondary container.

32. The method of claim 31, further comprising:

disposing a wick in said reservoir of said secondary container such that a portion of said wick extends from said reservoir access aperture; and disposing a grommet around said wick and substantially adjacent said reservoir access aperture.

33. The method of claim 32, further comprising:

sealing said secondary container and said primary container with a seal such that a portion of said secondary container is substantially fixed within said primary container.

34. The method of claim 33, wherein said sealing comprising applying wax to a portion of said primary container and at least a portion of said secondary container.

35. The method of claim 33, further comprising:

removing said seal from a portion of said secondary container.

36. The method of claim 25, further comprising:

removing said seal from all of said secondary container.

37. The method of claim 35, further comprising:

removing said seal from a portion of said secondary container.

38. The method of claim 35, further comprising:

removing said seal from said secondary container and said primary container.

39. The method of claim 35, further comprising:

igniting said flammable fluid absorbed by a portion of said wick extending outside of said secondary container through said reservoir access aperture.

40. A decorative apparatus, comprising:

a primary container defined by an upper portion and a lower portion, said primary container having an opening disposed toward said upper portion; and a secondary container having a cap and a reservoir body extending therefrom, said secondary container being disposed within said primary container such that said cap of said secondary container substantially corresponds to said opening of said primary container and said reservoir body extends therefrom toward said lower portion of said primary container in a suspended manner;

a reservoir access aperture disposed in said cap and accessible from outside said primary container;

a decorative article disposed between said primary container and said secondary container; and adhesive fixing said primary container to said secondary container thereby sealing said decorative article therebetween and sealing ambient air away from said decorative article.

41. The decorative apparatus of claim 40, further comprising:

a flammable fluid disposed within said reservoir body;

a wick disposed within said reservoir body and submerged at least partially in said flammable fluid having a portion of said wick extending outside of said secondary container through said reservoir access aperture;

a grommet disposed around said wick and contacting said cap at said reservoir access aperture.

42. The decorative apparatus of claim 40, wherein said decorative article comprises food.

43. The decorative apparatus of claim 42, wherein said decorative article further comprises a preservative.

44. A secondary container for a decorative apparatus, comprising:

a cap;

a reservoir extending from said cap, said reservoir being arranged and configured to receive and contain a flammable fluid therein and a wick; and a reservoir access aperture disposed in said cap, said reservoir access aperture being arranged and configured to provide access to said reservoir; and wherein said wick is disposed in said secondary container extending within said reservoir wherein a portion of said wick passes through said reservoir access aperture extending out of said secondary container;

a flammable fluid disposed in said reservoir; and a grommet being substantially concave disposed on said cap substantially corresponding to said reservoir access aperture to support said wick, said concave portion of said grommet having scented oil disposed therein;

wherein said secondary container having an opening is arranged and configured to be disposed within a primary container having an opening in a substantially suspended and sealed maimer such that said cap is disposed toward said opening and said reservoir extends therefrom.

45. The decorative apparatus of claim 44, wherein scented oil is disposed in said concave portion of said grommet.

* * * * *